US010287694B2

(12) United States Patent
Shin et al.

(10) Patent No.: US 10,287,694 B2
(45) Date of Patent: May 14, 2019

(54) AMALGAM ELECTRODE, METHOD FOR MANUFACTURING THE SAME, AND METHOD FOR ELECTROCHEMICAL REDUCTION OF CARBON DIOXIDE USING THE SAME

(71) Applicant: Sogang University Research Foundation, Seoul (KR)

(72) Inventors: Woonsup Shin, Seoul (KR); Mijung Park, Seoul (KR)

(73) Assignee: Sogang University Research Foundation, Seoul (KR)

( * ) Notice: Subject to any disclaimer, the term of this patent is extended or adjusted under 35 U.S.C. 154(b) by 224 days.

(21) Appl. No.: 15/037,236

(22) PCT Filed: Nov. 20, 2014

(86) PCT No.: PCT/KR2014/011172
§ 371 (c)(1),
(2) Date: May 17, 2016

(87) PCT Pub. No.: WO2015/076570
PCT Pub. Date: May 28, 2015

(65) Prior Publication Data

US 2016/0298247 A1 Oct. 13, 2016

(30) Foreign Application Priority Data

Nov. 20, 2013 (KR) ..... 10-2013-0141604

(51) Int. Cl.
*C25D 3/02* (2006.01)
*C25D 3/48* (2006.01)
(Continued)

(52) U.S. Cl.
CPC ..... *C25B 11/18* (2013.01); *C25B 3/04* (2013.01); *C25B 11/02* (2013.01); *C25B 11/035* (2013.01);
(Continued)

(58) Field of Classification Search
CPC ... C25D 3/00; C25D 3/22; C25D 3/30; C25D 3/36; C25D 3/38; C25D 3/46; C25D 3/48; C25D 3/54; C25D 5/56; C25D 3/02
(Continued)

(56) References Cited

U.S. PATENT DOCUMENTS 2,195,231 A * 3/1940 Weder ..... C25D 3/54 205/122
2,655,641 A * 10/1953 Asaff ..... H01R 4/20 403/272
(Continued)

FOREIGN PATENT DOCUMENTS

CN 2087784 U 10/1991
JP 56042103 B * 10/1981 ..... H01M 4/88
(Continued)

OTHER PUBLICATIONS

Gunasingham et al., "Anodic Stripping Voltammetry of Lead Using a Copper-Mercury Film Electrode," Analytica Chimica Acta (no month, 1991), vol. 246, pp. 309-313. (Year: 1991).*
(Continued)

*Primary Examiner* — Edna Wong
(74) *Attorney, Agent, or Firm* — Greer, Burns & Crain, Ltd.

(57) ABSTRACT

The present invention relates to a method for manufacturing an amalgam electrode, an amalgam electrode manufactured by the method, and a method for electrochemical reduction of carbon dioxide using the amalgam electrode.

9 Claims, 10 Drawing Sheets

(51) Int. Cl.

| | |
|---|---|
| ***C25D 3/56*** | (2006.01) |
| ***C25B 11/18*** | (2006.01) |
| ***C25B 3/04*** | (2006.01) |
| ***C25B 11/02*** | (2006.01) |
| ***C25B 11/03*** | (2006.01) |
| ***C25D 3/30*** | (2006.01) |
| ***C25D 3/46*** | (2006.01) |
| ***C25D 3/54*** | (2006.01) |
| ***C25D 5/10*** | (2006.01) |
| ***C25D 7/00*** | (2006.01) |
| ***C25D 3/60*** | (2006.01) |
| ***C25D 3/64*** | (2006.01) |

(52) U.S. Cl.
CPC ..... *C25D 3/30* (2013.01); *C25D 3/46* (2013.01); *C25D 3/54* (2013.01); *C25D 3/60* (2013.01); *C25D 3/64* (2013.01); *C25D 5/10* (2013.01); *C25D 7/00* (2013.01)

(58) Field of Classification Search
USPC ..... 205/170, 176, 238, 210, 220
See application file for complete search history.

(56) References Cited

U.S. PATENT DOCUMENTS

| | | | | |
|---|---|---|---|---|
| 3,576,415 | A | 4/1971 | Gwyn, Jr. | |
| 2006/0090791 | A1* | 5/2006 | Gaudiana ..... | H01L 27/301 136/256 |

FOREIGN PATENT DOCUMENTS

| | | |
|---|---|---|
| KR | 10-2005-0024547 | 3/2005 |
| KR | 10-2011-0076208 | 7/2011 |
| KR | 10-2012-0113685 | 10/2012 |
| KR | 10-2013-0065371 | 6/2013 |
| KR | 10-1324742 | 11/2013 |

OTHER PUBLICATIONS

Gunasingham et al., "Anodic Stripping of Lead Using a Copper-Mercury Film Electrode," Analytica Chimica Acta (1991), vol. 246, pp. 309-313. (Year: 1991).*

Shepherd et al., "Formation of Porous Metal Plates by Electrolytic Reduction," Journal of the Electrochemical Society (Aug. 1962), vol. 109, No. 8, pp. 657-661. (Year: 1962).*

Int'l. Search Report of PCT/KR2014/011172 dated Mar. 11, 2015.

* cited by examiner

AMALGAM ELECTRODE, METHOD FOR MANUFACTURING THE SAME, AND METHOD FOR ELECTROCHEMICAL REDUCTION OF CARBON DIOXIDE USING THE SAME

This is a National Phase Application filed under 35 U.S.C. § 371, of International Application No. PCT/KR2014/011172, filed Nov. 20, 2014.

TECHNICAL FIELD

The invention relates to a method for manufacturing an amalgam electrode, an amalgam electrode manufactured by the method, and a method for electrochemical reduction of carbon dioxide using the amalgam electrode.

BACKGROUND

Amalgam is an alloy of mercury and another metal. Such amalgam has electrode activities of mercury and can be formed into a solid phase. Thus, studies for utilizing the amalgam as an electrode material have been conducted. Generally, silver amalgam has been utilized in many cases. Recently, there has been reported a case where dental amalgam is applied to electrochemical reduction of carbon dioxide. In all of these cases, when an amalgam electrode is manufactured, a method (amalgam-setting reaction) of mixing metal powder with mercury into the dough at a high speed with an amalgamator and then putting and solidifying the dough in a mold having a predetermined shape is used. Particularly, dental amalgam is prepared by mixing mercury with amalgam powder, and amalgam powder is classified into low-copper amalgam and high-copper amalgam depending on the content of copper (Cu). For example, amalgam powder ANA 2000 produced by Nordiska contains Ag, Sn, and Cu in the amounts of 43.1 wt %, 30.8 wt %, and 26.1 wt %, respectively. Dental amalgam is prepared by mixing well the amalgam powder of 55 wt % and liquid mercury of 45 wt %. In this case, the final composition contains Hg (45 wt %), Ag (24 wt %), Sn (17 wt %), and Cu (14 wt %). The method for manufacturing an amalgam electrode by mixing and then solidifying as described above (see Korean Patent No. 1324742) has a problem that it cannot be applied to manufacturing an electrode by forming amalgam on surfaces of electrodes having various shapes, for example, a surface of a porous electrode.

DETAILED DESCRIPTION OF THE INVENTION

Problems to be Solved by the Invention

The present disclosure relates to a method for manufacturing an amalgam electrode, an amalgam electrode manufactured by the method, and a method for electrochemical reduction of carbon dioxide using the amalgam electrode.

However, problems to be solved by the present disclosure are not limited to the above-described problems. Although not described herein, other problems to be solved by the present disclosure can be clearly understood by those skilled in the art from the following descriptions.

Means for Solving the Problems

In accordance with a first aspect of the present disclosure, there is provided a method for manufacturing an amalgam electrode, including: electroplating mercury (Hg) and a metal selected from the group consisting of Ag, Sn, Cu, Zn, Pb, Sb, and combinations thereof on a surface of a substrate electrode.

In accordance with a second aspect of the present disclosure, there is provided an amalgam electrode manufactured according to the first aspect of the present disclosure.

In accordance with a third aspect of the present disclosure, there is provided a method for electrochemical reduction of carbon dioxide using the amalgam electrode according to the second aspect of the present disclosure.

Effect of the Invention

According to the present disclosure, an electrode of which only a surface is modified can be manufactured by forming safe dental amalgam having negligible mercury toxicity on surfaces of various substrate electrodes. Particularly, in the case of application to a porous structure, an amalgam electrode having a greater surface area can be manufactured. The amalgam electrode having such characteristics can be applied with a high efficiency to electrochemical conversion of carbon dioxide, electrochemical generation of hydrogen, and the like.

BEST MODE FOR CARRYING OUT THE INVENTION

Figure 1A:
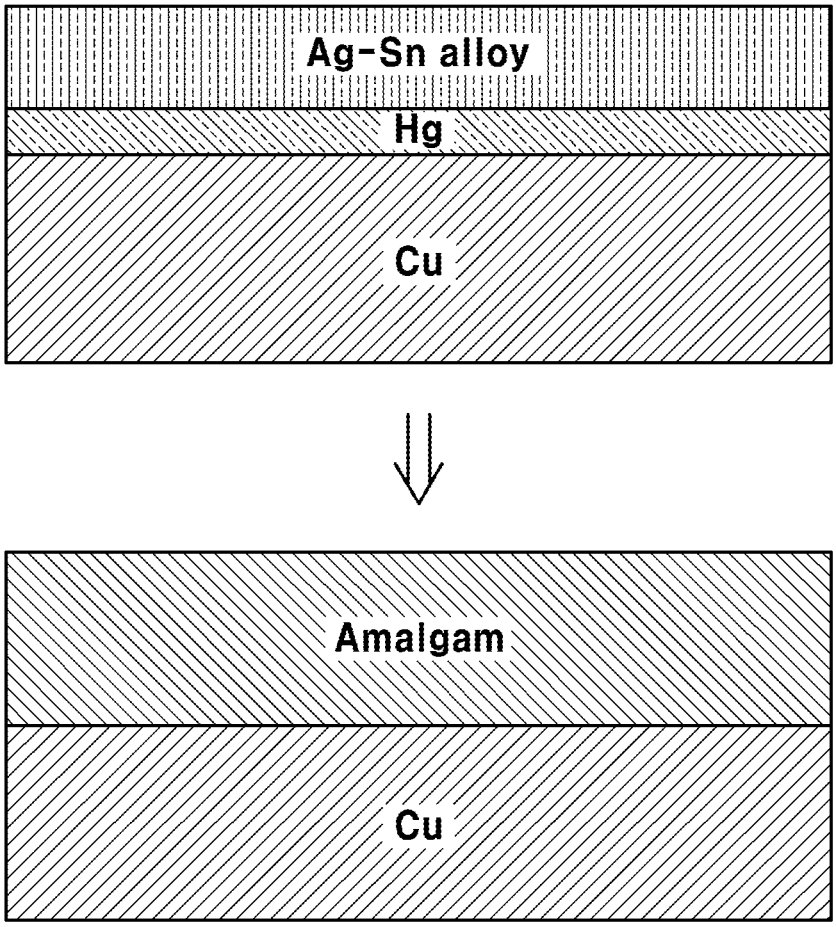
FIG. 1A and FIG. 1B are schematic diagrams illustrating a method for manufacturing an amalgam electrode in accordance with an example of the present disclosure.

Hereinafter, embodiments of the present disclosure will be described in detail with reference to the accompanying drawings so that the present disclosure may be readily implemented by those skilled in the art. However, it is to be noted that the present disclosure is not limited to the embodiments but can be embodied in various other ways. In drawings, parts irrelevant to the description are omitted for simplicity of explanation, and like reference numerals denote like parts through the whole document.

Through the whole document, the term "connected to" or "coupled to" that is used to designate a connection or coupling of one element to another element includes both a case that an element is "directly connected or coupled to" another element and a case that an element is "electronically connected or coupled to" another element via still another element.

Through the whole document, the term "on" that is used to designate a position of one element with respect to another element includes both a case that the one element is adjacent to the another element and a case that any other element exists between these two elements.

Further, through the whole document, the term "comprises or includes" and/or "comprising or including" used in the document means that one or more other components, steps, operation and/or existence or addition of elements are not excluded in addition to the described components, steps, operation and/or elements unless context dictates otherwise.

Through the whole document, the term "about or approximately" or "substantially" are intended to have meanings close to numerical values or ranges specified with an allowable error and intended to prevent accurate or absolute numerical values disclosed for understanding of the present disclosure from being illegally or unfairly used by any unconscionable third party.

Through the whole document, the term "step of" does not mean "step for".

Through the whole document, the term "combination of" included in Markush type description means mixture or combination of one or more components, steps, operations and/or elements selected from a group consisting of components, steps, operation and/or elements described in Markush type and thereby means that the disclosure includes one or more components, steps, operations and/or elements selected from the Markush group.

Through the whole document, a phrase in the form "A and/or B" means "A or B, or A and B".

Hereinafter, embodiments of the present disclosure will be described in detail. However, the present disclosure may not be limited to the following embodiments.

In accordance with a first aspect of the present disclosure, there is provided a method for manufacturing an amalgam electrode, including: electroplating mercury (Hg) and a metal selected from the group consisting of Ag, Sn, Cu, Zn, Pb, Sb, and combinations thereof on a surface of a substrate electrode. The amalgam according to the present disclosure may include dental amalgam, but may not be limited thereto. The dental amalgam supplies safe amalgam having negligible mercury toxicity, and may contain $Ag_2Hg_3$ as a main component, but may not be limited thereto.

In an embodiment of the present disclosure, the substrate electrode may include a porous substrate, a plate-shaped substrate, or a rod-shaped substrate, but may not be limited thereto. For example, the porous substrate may include a granule aggregate, a surface-treated porous electrode, a mesh-shaped metal electrode, but may not be limited thereto.

In an embodiment of the present disclosure, the substrate electrode may contain a material selected from the group consisting of copper, tin, nickel, carbon, glassy carbon, silver, gold, and combinations thereof, but may not be limited thereto.

In an embodiment of the present disclosure, the electroplating may include immerging the substrate electrode in a solution containing the mercury or the metal, and then electrochemically reducing the mercury or the metal to form a mercury layer or a metal layer on the surface of the substrate electrode, but may not be limited thereto.

The solution containing the mercury or the metal according to the present disclosure may contain ions of the mercury or the metal, but may not be limited thereto. The ions of the mercury or the metal may be supplied from salts of the mercury or the metal. The salts may include halides, nitrates, sulfates, sulfamates, alkane sulfonates, alkanol sulfonates, cyanides, acetates, or citrates of the mercury or the metal, but may not be limited thereto. For example, the solution containing the mercury or the metal may contain salts of the mercury or the metal, such as $Hg(NO_3)_2$, $SnSO_4$, or $Ag_2SO_4$, but may not be limited thereto.

In the solution containing the mercury or the metal according to the present disclosure, a concentration of the mercury or the metal may be about 30 mM or less, but may not be limited thereto. For example, in the solution containing the mercury or the metal, a concentration of the mercury or the metal may be about 2 mM or less, about 5 mM or less, about 10 mM or less, about 15 mM or less, about 20 mM or less, about 25 mM or less, or about 30 mM or less, but may not be limited thereto.

The solution according to the present disclosure may contain an electrolyte, and the electrolyte is not particularly limited. For example, the electrolyte may include KCN, $SC(NH_2)_2$, or $H_2SO_4$, but may not be limited thereto. In the solution according to the present disclosure, a concentration of the electrolyte may be about 10 M or less, but may not be limited thereto. For example, a concentration of the electrolyte in the solution may be about 0.1 M or less, about 0.2 M or less, about 1 M or less, about 2 M or less, about 5 M or less, or about 10 M or less, but may not be limited thereto.

The electrochemical reduction in the electroplating according to the present disclosure may be performed by various methods such as applying a constant voltage or a constant current, or change of a potential. For example, during the electrochemical reduction in the electroplating according to the present disclosure, if a constant current is applied, the applied constant current may be about 50 $mA/cm^2$ or less, but may not be limited thereto. For example, the constant current to be applied may be about 5 $mA/cm^2$ or less, about 8 $mA/cm^2$ or less, about 10 $mA/cm^2$ or less, about 15 $mA/cm^2$ or less, about 20 $mA/cm^2$ or less, about 25 $mA/cm^2$ or less, about 30 $mA/cm^2$ or less, about 35 $mA/cm^2$ or less, about 40 $mA/cm^2$ or less, about 45 $mA/cm^2$ or less, or about 50 $mA/cm^2$ or less, but may not be limited thereto. For example, during the electrochemical reduction in the electroplating according to the present disclosure, if a constant voltage is applied or a potential change may be used. The applied constant voltage or a range of the potential change may be from about −0.2 V to about −1.2 V (reference electrode: Ag/AgCl), but may not be limited thereto. For example, the applied constant voltage or a range of the potential change may be from about −0.2 V to about −1.2 V, from about −0.2 V to about −1 V, from about −0.2 V to about −0.8 V, from about −0.2 V to about −0.6 V, from about −0.2 V to about −0.4 V, from about −0.4 V to about −1.2 V, from about −0.4 V to about −1 V, from about −0.4 V to about −0.8 V, from about −0.4 V to about −0.6 V, from about −0.6 V to about −1.2 V, from about −0.6 V to about −1 V, from about −0.6 V to about −0.8 V, from about −0.8 V to about −1.2 V, from about −0.8 V to about −1 V, or from about −1 V to about −1.2 V, but may not be limited thereto.

In an embodiment of the present disclosure, the method for manufacturing an amalgam electrode may include: forming a mercury layer on the surface of the substrate electrode by the electroplating; forming a metal layer containing the metal selected from the group consisting of Ag, Sn, Cu, Zn, Pb, Sb, and combinations thereof on the mercury layer by the electroplating; and amalgam-setting the mercury layer and the metal layer, and the above-described process may be performed by one or more times, but may not be limited thereto.

In an embodiment of the present disclosure, the method for manufacturing an amalgam electrode may include: forming a metal layer containing the metal selected from the group consisting of Ag, Sn, Cu, Zn, Pb, Sb, and combinations thereof on the surface of the substrate electrode by the electroplating; forming a mercury layer on the metal layer by the electroplating; and amalgam-setting the metal layer and the mercury layer, and the above-described process may be performed by one or more times, but may not be limited thereto.

Each of the mercury layer and the metal layer according to the present disclosure may have a thickness of from about 0.1 μm to about 2 μm, but may not be limited thereto. For example, each of the mercury layer and the metal layer may have a thickness of from about 0.1 μm to about 2 μm, from about 0.1 μm to about 1.5 μm, from about 0.1 μm to about 1 μm, from about 0.1 μm to about 0.5 μm, from about 0.5 μm to about 2 μm, from about 0.5 μm to about 1.5 μm, from about 0.5 μm to about 1 μm, from about 1 μm to about 2 μm, from about 1 μm to about 1.5 μm, or from about 1.5 μm to about 2 μm, but may not be limited thereto.

According to the present disclosure, the amalgam electrode may contain Hg of from about 35 parts by weight to about 55 parts by weight, Ag of from about 14 parts by weight to about 34 parts by weight, Sn of from about 7 parts by weight to about 17 parts by weight, and Cu of from about 4 parts by weight to about 24 parts by weight, but may not be limited thereto.

In accordance with a second aspect of the present disclosure, there is provided an amalgam electrode manufactured according to the first aspect. All the descriptions about the first aspect of the present disclosure can be applied to the amalgam electrode according to the present aspect.

In accordance with a third aspect of the present disclosure, there is provided a method for electrochemical reduction of carbon dioxide using the amalgam electrode according to the second aspect. All the descriptions about the first aspect and the second aspect of the present disclosure can be applied to the amalgam electrode according to the present aspect.

In an embodiment of the present disclosure, the method for electrochemical reduction of carbon dioxide may include: supplying a solution containing carbon dioxide to a reduction electrode unit in an electrochemical reactor; and reducing the carbon dioxide by applying a current to a working electrode including the amalgam electrode and a counter electrode, but may not be limited thereto.

In an embodiment of the present disclosure, the solution may contain an electrolyte selected from the group consisting of $KHCO_3$, $NaHCO_3$, $K_2SO_4$, NaCl, KCl, and combinations thereof, but may not be limited thereto. In the solution according to the present disclosure, a concentration of the electrolyte may be from about 5 M or less, but may not be limited thereto. For example, a concentration of the electrolyte may be from about 0.5 M or less, from about 1 M or less, from about 2 M or less, from about 3 M or less, from about 4 M or less, or from about 5 M or less, but may not be limited thereto.

In an embodiment of the present disclosure, the current (current density) may be from about 1 mA/cm$^2$ to about 200 mA/cm$^2$, but may not be limited thereto. For example, the current may be from about 1 mA/cm$^2$ to about 200 mA/cm$^2$, from about 1 mA/cm$^2$ to about 150 mA/cm$^2$, from about 1 mA/cm$^2$ to about 100 mA/cm$^2$, from about 1 mA/cm$^2$ to about 50 mA/cm$^2$, from about 50 mA/cm$^2$ to about 200 mA/cm$^2$, from about 50 mA/cm$^2$ to about 150 mA/cm$^2$, from about 50 mA/cm$^2$ to about 100 mA/cm$^2$, from about 100 mA/cm$^2$ to about 200 mA/cm$^2$, from about 100 mA/cm$^2$ to about 150 mA/cm$^2$, or from about 150 mA/cm$^2$ to about 200 mA/cm$^2$, but may not be limited thereto.

In the method for electrochemical reduction of carbon dioxide according to the present disclosure, if a plate-shaped amalgam electrode is used, when a current density of from about 5 mA/cm$^2$ to about 10 mA/cm$^2$ or more is applied, it is impossible to stably and efficiently perform electrolysis. However, if a porous amalgam electrode is used, it is possible to stably perform electrolysis even at about 10 or more times higher density.

The efficiency of the method for reduction according to the present disclosure may be measured using the efficiency of a conversion into formate, but may not be limited thereto.

In the method for reduction according to the present disclosure, a current efficiency may be from about 80% or more or from about 90% or more, but may not be limited thereto.

In the method for reduction according to the present disclosure, the conversion into formate may be continued for about 8 hours or longer, but may not be limited thereto. For example, during the reduction, the conversion into formate may be continued for about 8 hours or longer, about 9 hours or longer, about 12 hours or longer, about 15 hours or longer, about 18 hours or longer, or about 21 hours or longer, but may not be limited thereto.

Mode for Carrying Out the Invention

Hereinafter, examples will be described in more detail with reference to the accompanying drawings. However, the following examples are provided only for more easily understanding of the present disclosure, but the present disclosure is not limited thereto.

EXAMPLE

Example 1

Porous Amalgam Electrode in which Ag—Sn Layer is Formed after Hg Layer is Formed A mesh-shaped porous copper electrode was impregnated in a 10 mM $Hg(NO_3)_2$ solution containing 0.1 M KCN as an electrolyte, and then reduced by a constant current of 8 mA/cm$^2$ to form a Hg layer by electroplating Hg on a surface of the porous copper electrode. The electrode including the very thin Hg layer thereon was put into a 20 mM $SnSO_4$/2 mM $Ag_2SO_4$ solution containing 0.2 M $SC(NH_2)_2$ and 2 M $H_2SO_4$ as electrolytes. Then, a constant current of 10 mA/cm$^2$ was applied thereto to secondarily electroplate an Ag—Sn layer. In this case, a plate-shaped Sn electrode was used as a counter electrode. With the lapse of time of about 1 day, it was observed that an amalgam-setting reaction of Hg and Ag—Sn occurred and a hard solid electrode was formed. FIG. 1A shows a schematic diagram illustrating a method for manufacturing the porous amalgam electrode according to the present Example.

Example 2

Figure 1B:
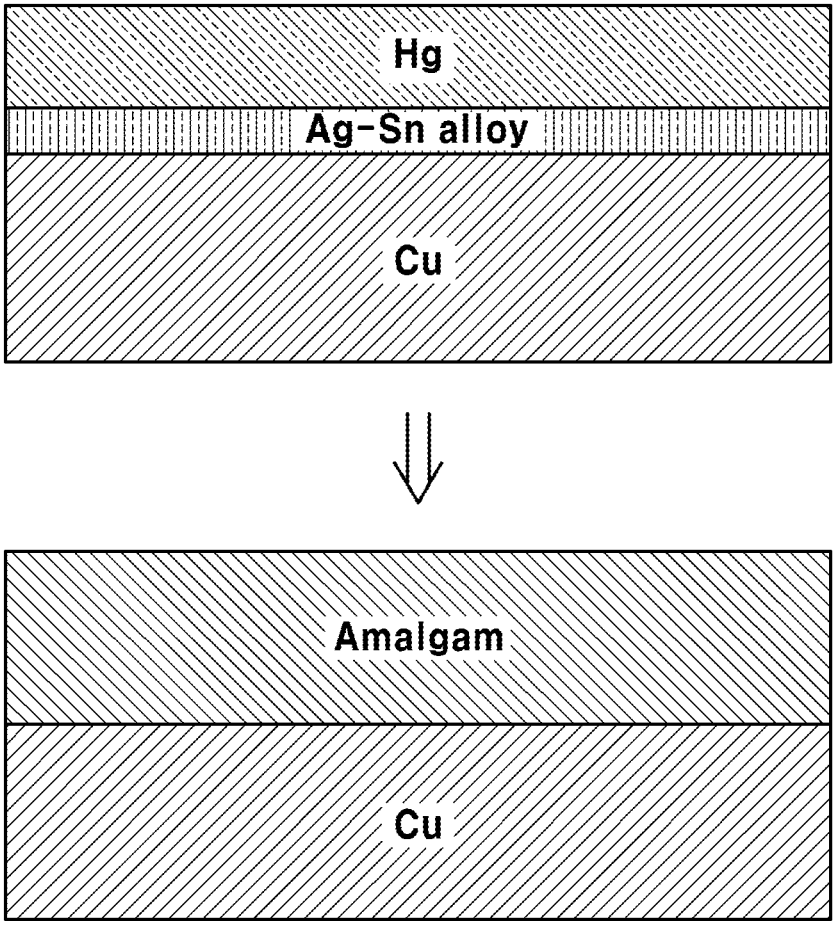

Porous Amalgam Electrode in which Hg Layer is Formed after Ag—Sn Layer is Formed A mesh-shaped porous copper electrode was impregnated in a 20 mM $SnSO_4$/2 mM $Ag_2SO_4$ solution containing 0.2 M $SC(NH_2)_2$ and 2 M $H_2SO_4$ as electrolytes. Then, a constant current of 10 mA/cm$^2$ was applied thereto to primarily form an Ag—Sn layer including $Ag_3Sn$. In this case, a plate-shaped Sn electrode was used as a counter electrode. The electrode including the Ag—Sn layer thereon was put into a 10 mM $Hg(NO_3)_2$ solution containing 0.1 M KCN as an electrolyte and then, reduced by a constant current of 8 mA/cm$^2$ to secondarily electroplate a Hg layer. With the lapse of time, it was observed that an amalgam-setting reaction of Ag—Sn and Hg occurred and a porous amalgam electrode was formed. FIG. 1B shows a schematic diagram illustrating a method for manufacturing the porous amalgam electrode according to the present Example.

Example 3

Electrochemical Reduction of Carbon Dioxide Using Porous Amalgam Electrode

The porous amalgam electrode manufactured in Example 1 was used for electrochemical reduction of carbon dioxide. To be specific, a 0.5 M $K_2SO_4$ solution, the porous amalgam electrode, and an IrOx-coated Ti electrode (counter electrode) were used. A constant current circuit KS RnD 10 A was used to apply a constant current to the porous amalgam electrode having an apparent area of 9 cm$^2$. Then, the efficiency (current efficiency) and duration for generation of formate were observed.

(1) In the Case of Applying a Current of 40 mA/Cm$^2$

Figure 2:
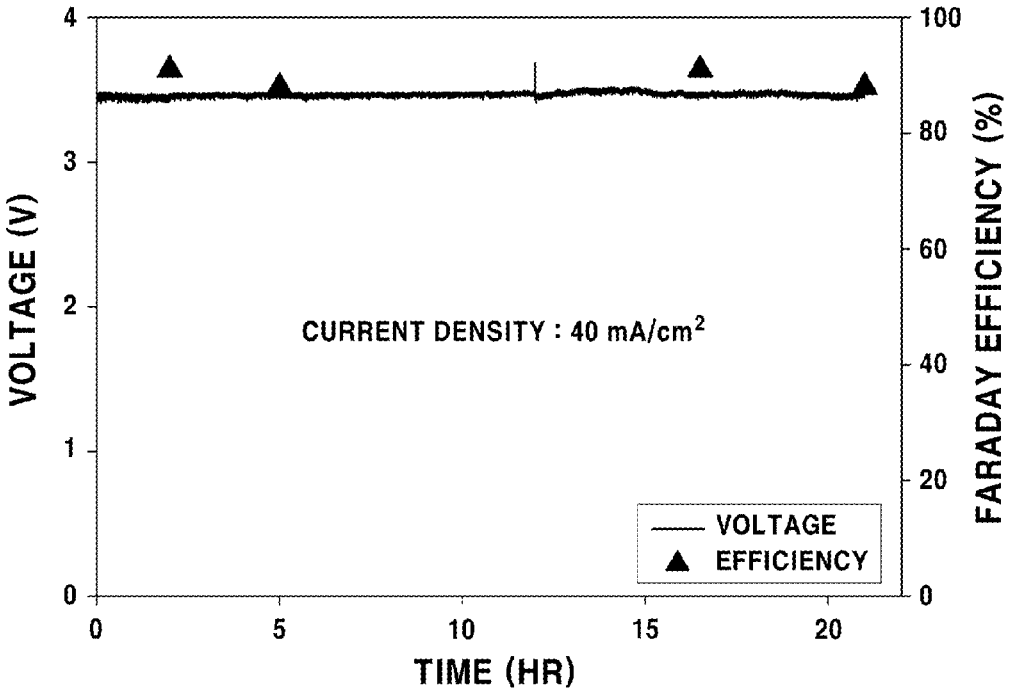
FIG. 2 is a graph showing a voltage of a reduction electrode depending on a constant current during electrochemical reduction of carbon dioxide using an amalgam electrode in accordance with an example of the present disclosure.

In the case of applying a constant current of 40 mA/cm$^2$ to the porous amalgam electrode according to Example 1, it was observed that a voltage of about 3.6 V was applied to both ends and the efficiency of a conversion into formate was as high as about 90% for about 21 hours. A result thereof was as shown in FIG. 2. Further, it was observed that a concentration of the generated formate was about 0.5 M.

(2) In the Case of Applying a Current of 100 mA/Cm$^2$

Figure 3:
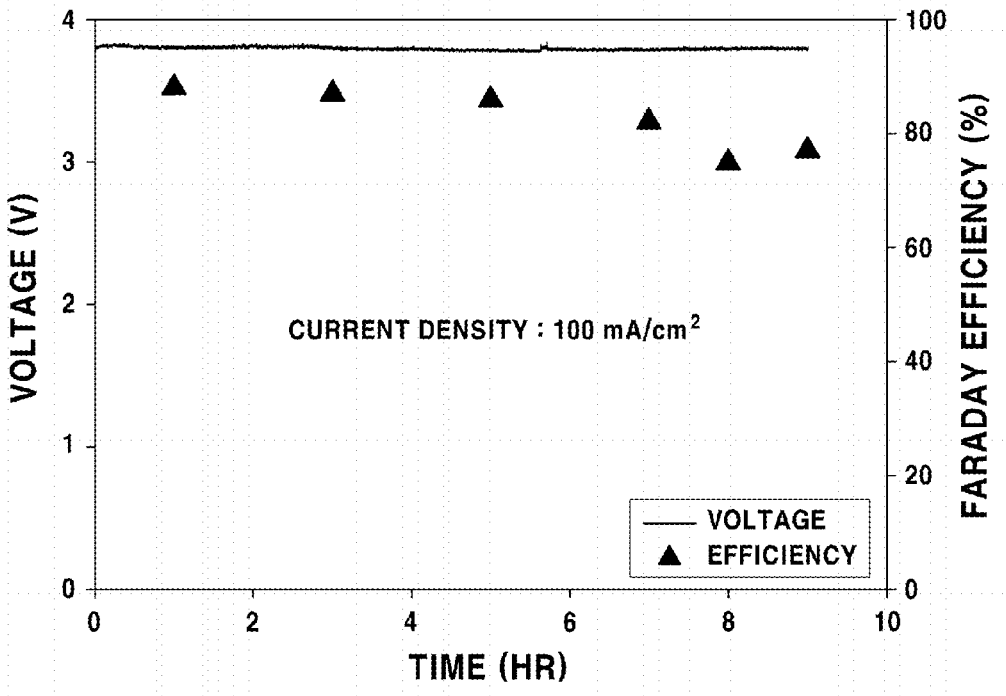
FIG. 3 is a graph showing efficiency (%) of a reduction electrode depending on a constant current during electrochemical reduction of carbon dioxide using an amalgam electrode in accordance with an example of the present disclosure.

In the case of applying a constant current of 100 mA/cm$^2$ to the porous amalgam electrode according to Example 1, it was observed that a voltage of about 3.8 V was applied to both ends and formate was generated with an efficiency of from about 80% to about 90% for about 9 hours. A result thereof was as shown in FIG. 3. Further, it was observed that a concentration of the generated formate was about 0.5 M.

Experimental Example 1

Optical Microscopy Analysis

Figure 4A:
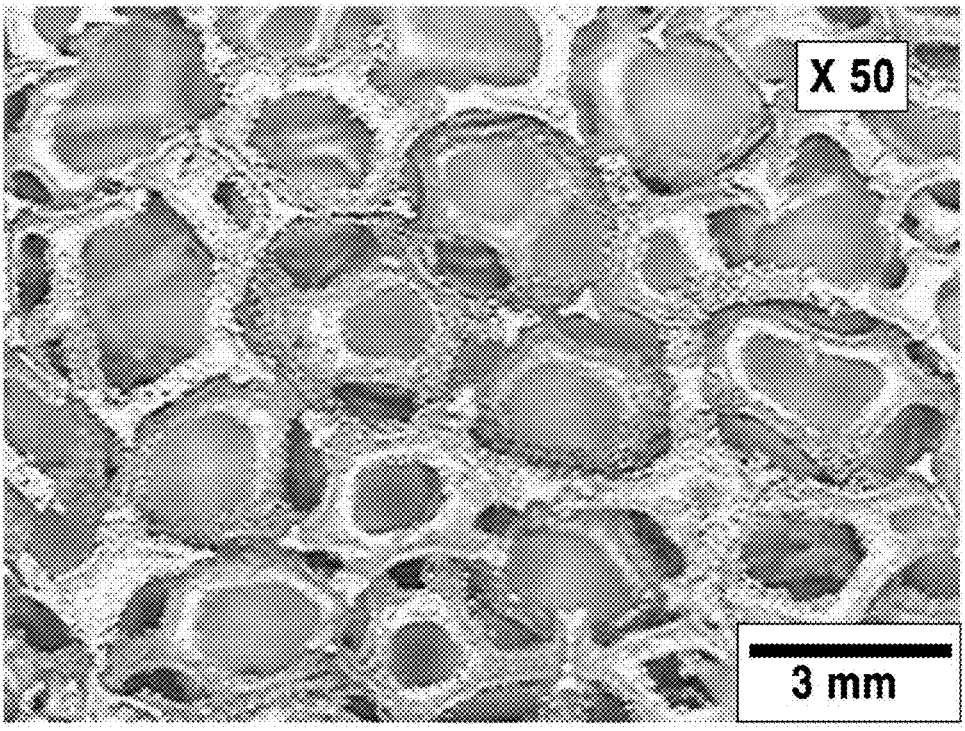
FIG. 4A and FIG. 4B are optical microscopic images showing surfaces of an amalgam electrode in accordance with an example of the present disclosure.
Figure 4B:
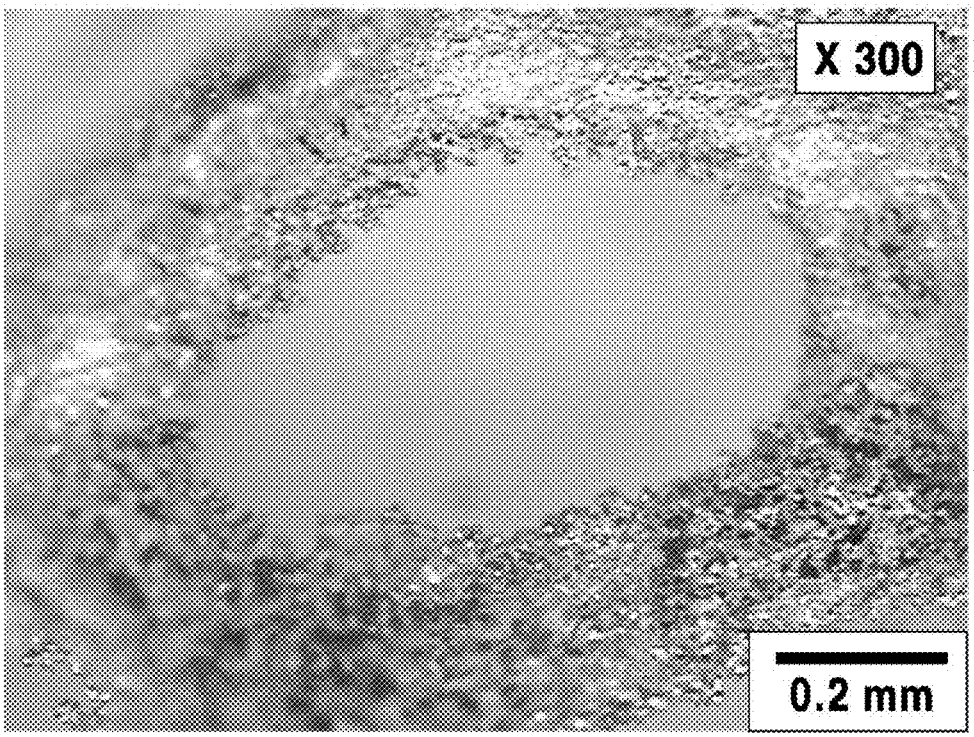

An optical microscopy analysis of a surface of the porous amalgam electrode manufactured in Example 1 was conducted using an Xi-CAM (Bestecvision Co. Ltd.). A result thereof was as shown in FIG. 4A and FIG. 4B. As a result of observing the surface of the porous amalgam electrode manufactured in Example 1, copper was not seen, but it could be seen that amalgam was electroplated well (FIG. 4A). To be specific, it could be seen that a porous surface was formed after amalgam was produced (FIG. 4B).

Experimental Example 2

X-Ray Diffraction (XRD) Analysis

Figure 5:
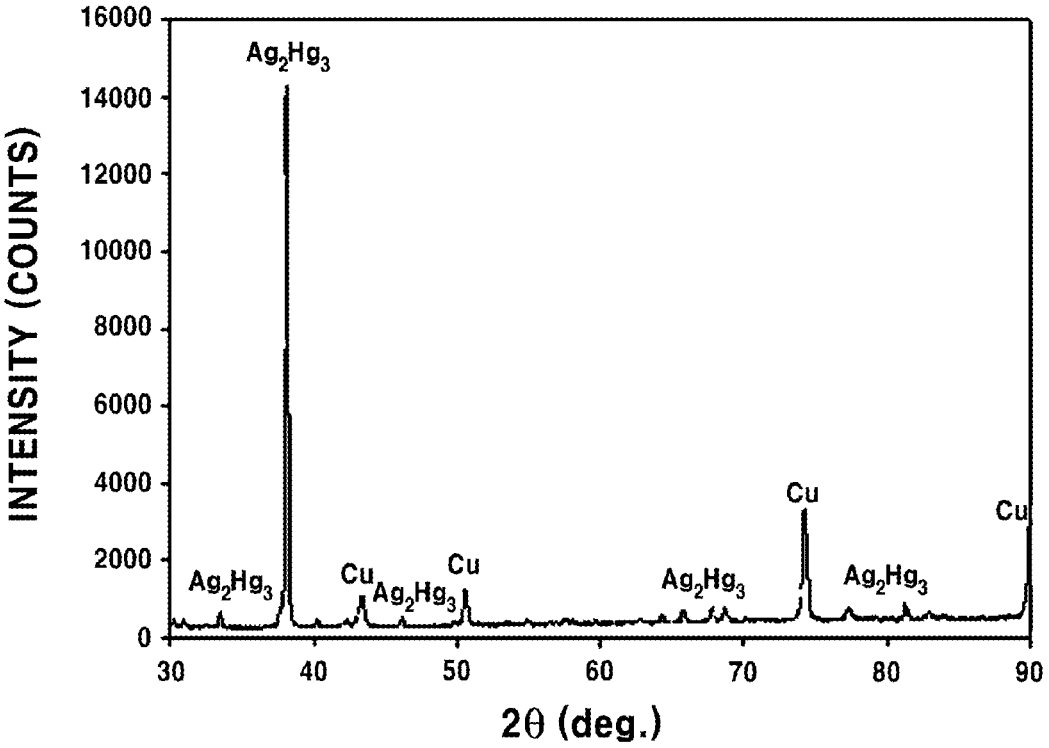
FIG. 5 is a graph showing a result of X-ray diffraction (XRD) analysis of an amalgam electrode in accordance with an example of the present disclosure.
Figure 6:
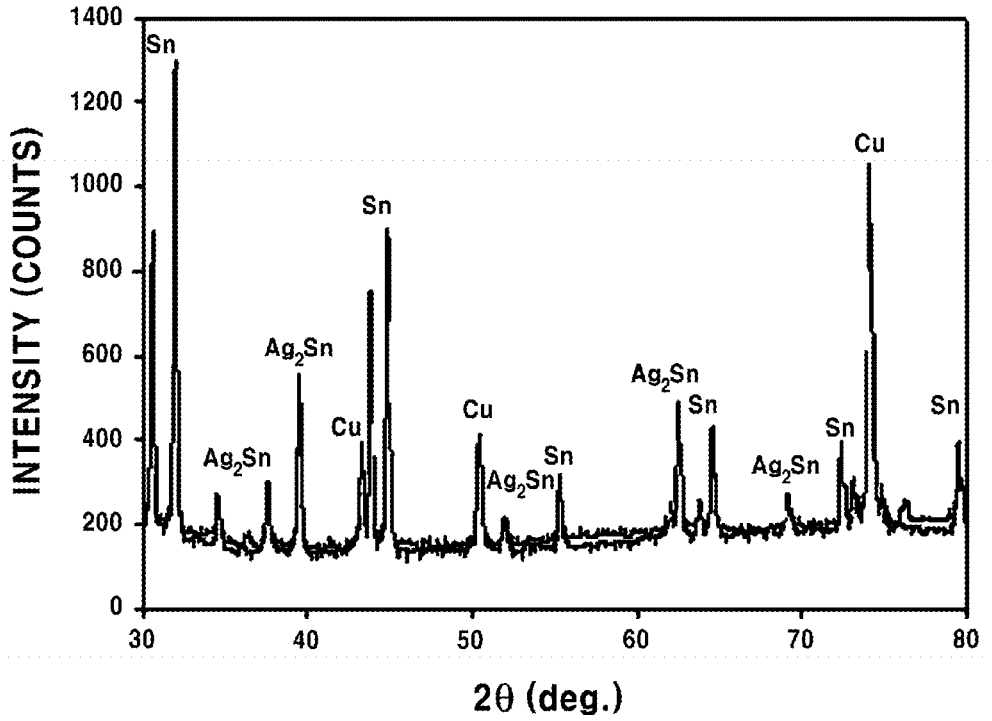
FIG. 6 is a graph showing a result of X-ray diffraction (XRD) analysis of a metal layer on a surface of a substrate electrode before amalgam is formed in accordance with an example of the present disclosure.
Figure 7:
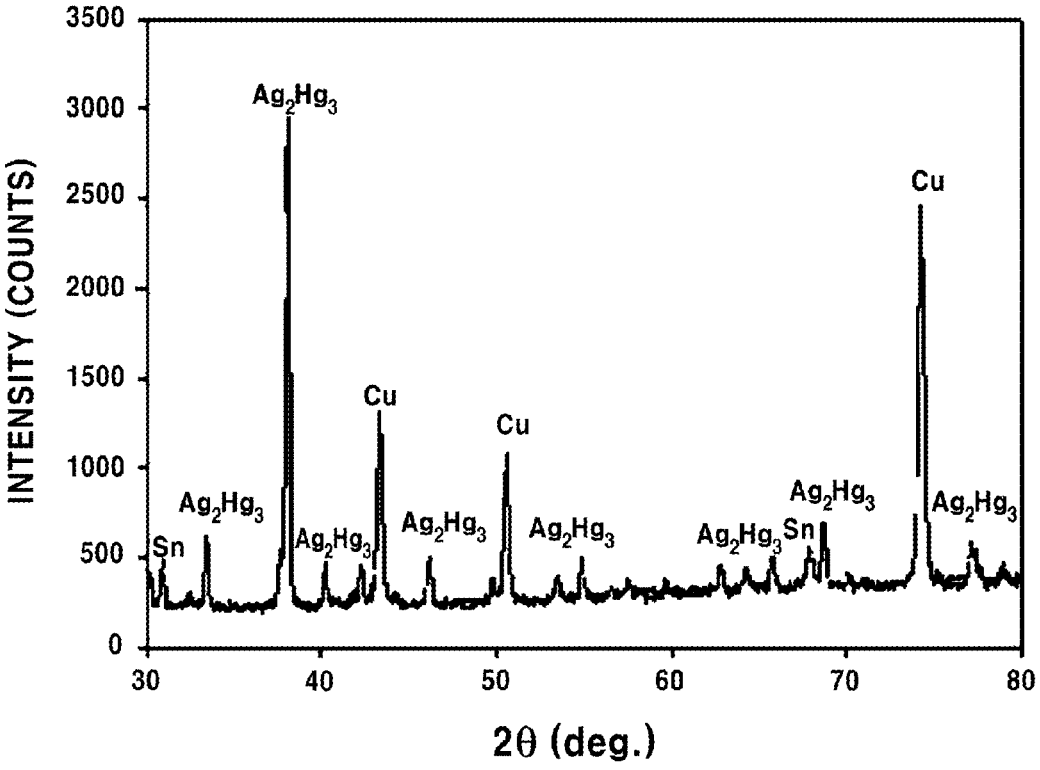
FIG. 7 is a graph showing a result of X-ray diffraction (XRD) analysis of an amalgam electrode in accordance with an example of the present disclosure.

An XRD analysis of the porous amalgam electrodes manufactured in Examples 1 and 2 was conducted using a Mini Flex II (Rigaku). A result thereof was as shown in FIG. 5 to FIG. 7. To be specific, FIG. 5 shows a result of the porous amalgam electrode according to Example 1, FIG. 6 shows a result of the XRD analysis after an Ag—Sn layer was formed first on the porous copper electrode in Example 2, and FIG. 7 shows a result of the porous amalgam electrode according to Example 2. As a result, it could be seen from the both Experimental Examples that $Ag_2Hg_3$ as a main component of dental amalgam was formed.

Experimental Example 3

Figure 8:
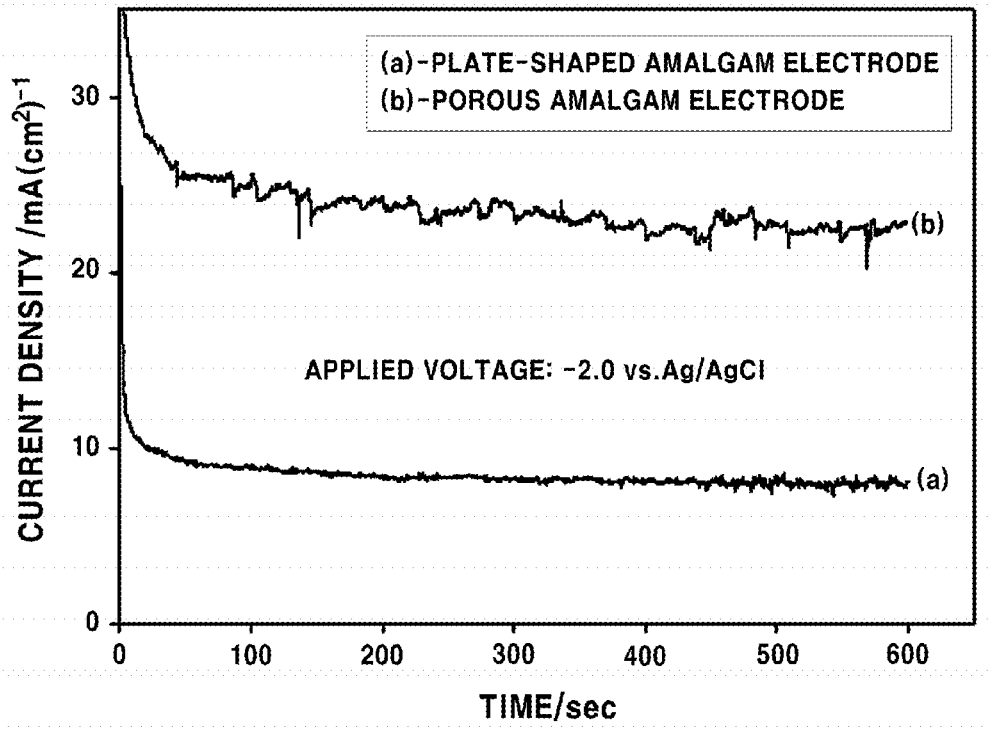
FIG. 8 is a graph showing a current density depending on a constant voltage during a hydrogen generation reaction using an amalgam electrode in accordance with an example of the present disclosure.

Measurement of Electrochemical Generation of Hydrogen Using Porous Amalgam Electrode Each of a plate-shaped amalgam electrode and the porous amalgam electrode according to Example 1 was used in an electrochemical hydrogen generation experiment [using an EG & G 273 A Potentiostat (Princeton Applied Research)]. When electrolysis was performed by applying a constant voltage of −2.0 V to an Ag/AgCl reference electrode in a 0.5 M $KHCO_3$/2 M KCl mixed solution, a current density was about 10 mA/cm$^2$ and a hydrogen generation reaction occurred in the case of using the plate-shaped amalgam electrode, and a current density was about 25 mA/cm$^2$ and a hydrogen generation reaction occurred in the case of using the porous amalgam electrode according to Example 1. Such a result was as shown in FIG. 8. It could be seen that the porous amalgam electrode having a higher current density with the same area as compared with the plate-shaped electrode can be used to manufacture an efficient electrolysis system.

According to the results of Examples and Experimental Examples, the amalgam electrode according to the present Example could be applied to a porous electrode since amalgam was formed on a surface of the porous electrode by electroplating a mercury layer and a metal layer. It could be seen that the amalgam electrode supplied a greater surface area due to its porosity, and, thus, electrochemical reduction of carbon dioxide and electrochemical generation of hydrogen had a high efficiency using the porous amalgam electrode.

The above description of the present disclosure is provided for the purpose of illustration, and it would be understood by those skilled in the art that various changes and modifications may be made without changing technical conception and essential features of the present disclosure. Thus, it is clear that the above-described examples are illustrative in all aspects and do not limit the present disclosure. For example, each component described to be of a single type can be implemented in a distributed manner. Likewise, components described to be distributed can be implemented in a combined manner.

The scope of the present disclosure is defined by the following claims rather than by the detailed description of the embodiment. It shall be understood that all modifications and embodiments conceived from the meaning and scope of the claims and their equivalents are included in the scope of the present disclosure.

We claim:

1. A method for manufacturing a porous amalgam electrode for electrochemical reduction of carbon dioxide, comprising:

electroplating mercury (Hg) and a metal selected from the group consisting of Ag, Sn, Cu, Zn, Pb, Sb, and combinations thereof on a surface of a porous substrate electrode to form the porous amalgam electrode, wherein the electroplating includes immerging the porous substrate electrode in a solution containing the mercury or the metal, and then electrochemically reducing the mercury or the metal.

2. The method for manufacturing a porous amalgam electrode for electrochemical reduction of carbon dioxide of claim 1, wherein the porous substrate electrode contains a material selected from the group consisting of copper, tin, nickel, carbon, glassy carbon, silver, gold, and combinations thereof.

3. The method for manufacturing a porous amalgam electrode for electrochemical reduction of carbon dioxide of claim 1, including:

forming a mercury layer on the surface of the porous substrate electrode by the electroplating;

forming a metal layer containing the metal selected from the group consisting of Ag, Sn, Cu, Zn, Pb, Sb, and combinations thereof on the mercury layer by the electroplating; and amalgam-setting the mercury layer and the metal layer to form the porous amalgam electrode, wherein the above-described process is performed by one or more times.

4. The method for manufacturing a porous amalgam electrode for electrochemical reduction of carbon dioxide of claim 1, including:

forming a metal layer containing the metal selected from the group consisting of Ag, Sn, Cu, Zn, Pb, Sb, and combinations thereof on the surface of the porous substrate electrode by the electroplating;

forming a mercury layer on the metal layer by the electroplating; and amalgam-setting the metal layer and the mercury layer to form the porous amalgam electrode, wherein the above-described process is performed by one or more times.

5. The method for manufacturing a porous amalgam electrode for electrochemical reduction of carbon dioxide of claim 1, wherein two metals selected from the group consisting of Ag, Sn, Cu, Zn, Pb, Sb and combinations thereof, are electroplated on the surface of the porous substrate electrode.

6. The method for manufacturing a porous amalgam electrode for electrochemical reduction of carbon dioxide of claim 1, wherein the electroplating comprises:

immerging the porous substrate electrode in a first solution comprising the mercury;

forming a mercury layer on the surface of the porous substrate electrode by the electroplating;

immerging the porous substrate electrode with the mercury layer in a second solution comprising two metals selected from the group consisting of Ag, Sn, Cu, Zn, Pb, Sb and combinations thereof;

forming a metal layer on the mercury layer by the electroplating; and, amalgam-setting the mercury layer and the metal layer to form the porous amalgam electrode.

7. The method of claim 6, wherein the porous substrate electrode comprises a material selected from the group consisting of copper, tin, nickel, carbon, glassy carbon, silver, gold, and combinations thereof.

8. The method for manufacturing a porous amalgam electrode for electrochemical reduction of carbon dioxide of claim 1, wherein the electroplating comprises:

immerging the porous substrate electrode in a first solution comprising two metals selected from the group consisting of Ag, Sn, Cu, Zn, Pb, Sb and combinations thereof;

forming a metal layer on the surface of the porous substrate electrode by the electroplating;

immerging the porous substrate electrode with the metal layer in a second solution comprising the mercury;

forming a mercury layer on the metal layer by the electroplating; and, amalgam-setting the mercury layer and the metal layer to form the porous amalgam electrode.

9. The method of claim 8, wherein the porous substrate electrode comprises a material selected from the group consisting of copper, tin, nickel, carbon, glassy carbon, silver, gold, and combinations thereof.

* * * * *